US005880699A

United States Patent [19]

McCorkle

[11] Patent Number: 5,880,699

[45] Date of Patent: Mar. 9, 1999

[54] ULTRA-WIDE BANDWIDTH DISH ANTENNA

[75] Inventor: John W. McCorkle, Laurel, Md.

[73] Assignee: The United States of America as represented by Secretary of the Army, Washington, D.C.

[21] Appl. No.: 876,661

[22] Filed: Jun. 16, 1997

[51] Int. Cl.[6] ..... H01Q 19/19

[52] U.S. Cl. ..... 343/840; 343/850

[58] Field of Search ..... 343/840, 850, 343/912

[56] References Cited

U.S. PATENT DOCUMENTS

| | | | |
|---|---|---|---|
| 4,095,230 | 6/1978 | Salmond et al. | 343/729 |
| 4,730,195 | 3/1988 | Philllips et al. . | |
| 5,148,130 | 9/1992 | Dietrich . | |
| 5,220,340 | 6/1993 | Shafai | 343/895 |
| 5,296,823 | 3/1994 | Dietrich . | |
| 5,379,006 | 1/1995 | McCorkle . | |

*Primary Examiner*—Frank G. Font
*Assistant Examiner*—Tu T. Nguyen
*Attorney, Agent, or Firm*—Paul S. Clohan

[57] ABSTRACT

An ultra-wide bandwidth dish antenna includes a plurality of transmission lines embedded in feed arms extending from an edge of a reflective dish, The first transmission line is for input and is connected in parallel to two receptive transmission lines having twice the characteristic impedance of the input transmission line, where one of the receptive transmission lines is inverted relative to the other The two receptive transmission lines are each bonded and embedded within separate feed arms of the antenna. The feed arms of the dish antenna converge to a point (apex) where the conductors of the embedded transmission lines are connected. The connection forces a signal on the exterior of the feed arms creating an electric and magnetic field enabling an electromagnetic wave to be propagated down the feed arms and launched into the reflective dish to be radiated outward.

24 Claims, 7 Drawing Sheets

ULTRA-WIDE BANDWIDTH DISH ANTENNA

BACKGROUND OF THE INVENTION

1. Technical Field

The present invention pertains to improvements in ultra-wide bandwidth baluns for dish antennas. In particular, the invention is an improvement of the apparatus disclosed in U.S. Pat. No. 5,379,006 (McCorkle). The disclosure in the patent is expressly incorporated by reference herein in its entirety.

2. Discussion of Prior Art

Impulse radar has numerous uses in various radar systems to detect aircraft, ground vehicles, people, mines, buried pipes, roadways, etc. Transmitting antennas for these systems typically require a balanced feed, while transmitters typically produce energy in an unbalanced feed. Numerous commercially available baluns do not have the bandwidth, balance, insertion loss or power handling capabilities required for ultra-wide bandwidth (UWB) applications, that is, applications involving frequencies from DC to gigahertz (GHz).

The above-referenced McCorkle U.S. Pat. No. (5,379,006) discloses in FIG. 4 of that patent a balun for ultra-wide bandwidth applications. Specifically, an input transmission line is connected in parallel with two output transmission lines such that one output transmission line is inverted with respect to the other. Each of the two output transmission lines has twice the characteristic impedance of the input transmission line, and all three of the transmission lines have a center conductor surrounded by an exterior shield (e.g., coaxial lines). At a junction where the input transmission line is connected in parallel with the two output transmission lines, the center conductor of the input transmission line is connected to coupled exterior shields of the two output transmission lines. Each of the center conductors of the two output transmission lines are connected to the exterior shield of the input transmission line. This configuration enables a signal from the input transmission line to be divided into two equal and opposite signals, each to be carried by a corresponding one of the two transmission lines. Ferrite cores along each of the two transmission lines provide inductance to isolate the parallel connection of the transmission lines and form balanced signals. For matching over the range of UWB frequencies (i.e., DC to GHz), an RC network is placed between exterior shields of the two transmission lines subsequent to the parallel connection. This balun has the capability of ultra-wide bandwidth applications from DC to GHz.

While the above-described balun provides a balanced feed, it would be desirable to mount the balun in a manner that avoids obstructing the antenna aperture. Further, it would be desirable to feed dish antennas through the feed arms of the antenna.

OBJECTS AND SUMMARY OF THE INVENTION

Accordingly, it is an object of the present invention to provide an ultra-wide bandwidth antenna having an inexpensive, simple feed and balun structure, and a method of operating the same, which maintains low insertion loss, good balance, and high power capability for ultra-wide bandwidth applications.

It is another object of the present invention to provide an improved method and apparatus for feeding dish antennas through feed arms which constitute a balanced load.

It is another object of the present invention to mount a balun on an antenna without obstructing the aperture.

According to the present invention, an UWB antenna is provided in which the output transmission lines of the feed and balun arrangement described above are embedded within separate feed arms of the antenna. The feed arms extend from opposite edges of a reflective dish of the antenna to converge at a point or apex where center conductors of the embedded output transmission lines are connected, either directly or through a network such as a parallel RC (resistor capacitor) circuit. The feed arms can be connected to the reflective dish either directly or through a network, such as an RC circuit, and are electrically driven at the apex by the shields of the output transmission lines, which are connected to the feed arms at or near the apex. Due to the equal but opposite signals carried by the output transmission lines, the connection of the center conductors at the apex of the antenna forces the two center conductors to form a virtual ground at that point, which in turn forces the signal onto the shields which are connected to the feed arms at the apex. The feed arms of the antenna radiate a TEM mode electromagnetic wave from the apex toward the edge where the feed arms are coupled with the dish. At high frequencies, the electromagnetic wave reflects off of the dish enabling outward radiation of the electromagnetic wave. At low frequencies, the feed arms together with the dish form a loop, enabling outward radiation of low frequency waves.

DESCRIPTION OF THE PREFERRED EMBODIMENTS

Figure 1:
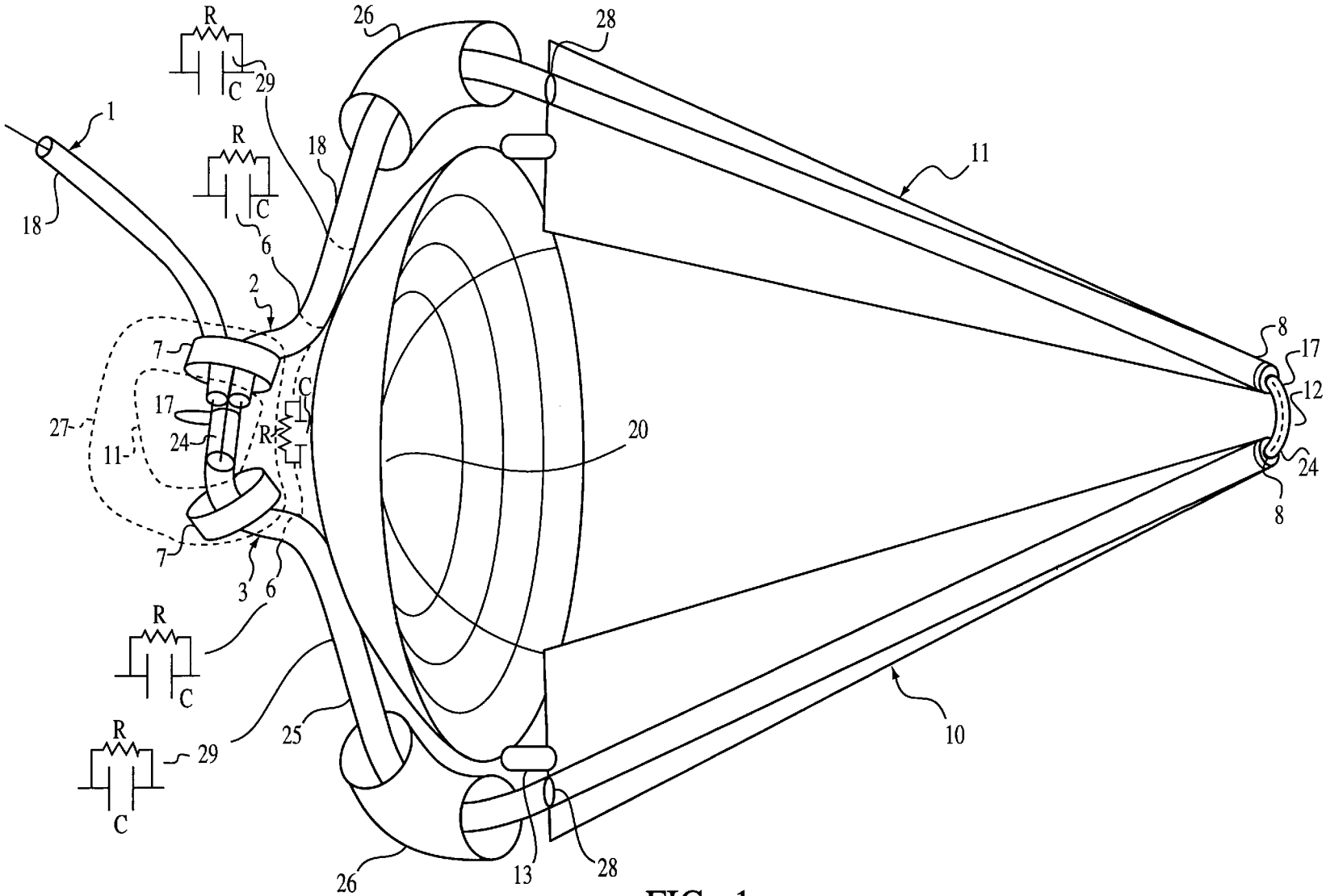
FIG. 1 is a view in perspective of a dish antenna employing a feed and balun according to the present invention.
Figure 3:
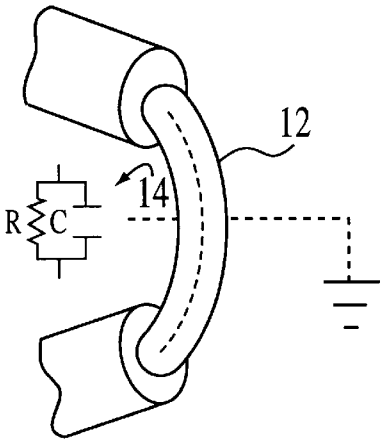
FIG. 3 is a partially diagrammatic view in perspective of the connection of the two center conductors extending across the apex of the feed arms.
Figure 2:
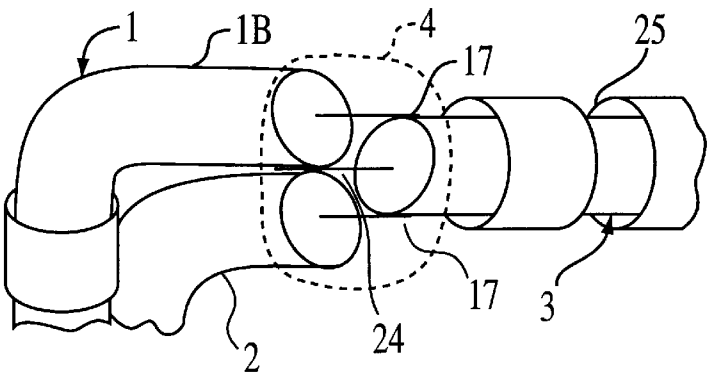
FIG. 2 is an enlarged perspective view of the junction where the transmission lines are connected.
Figure 5:
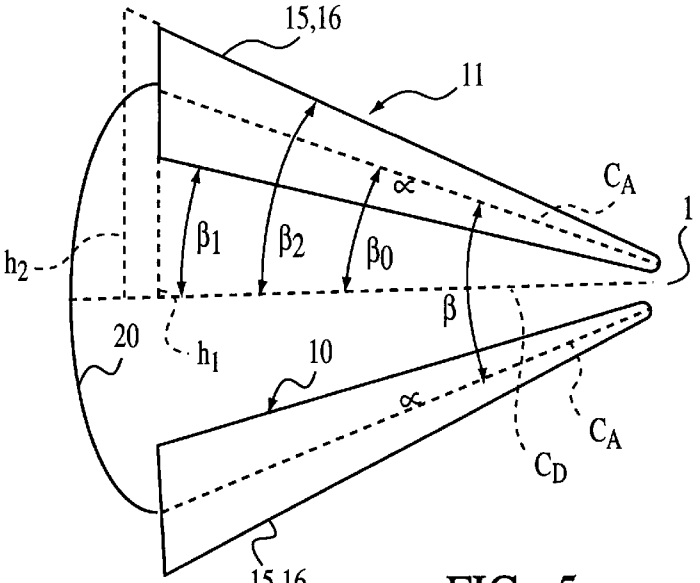
FIG. 5 is a diagrammatic illustration of the dish antenna and feed arms showing the angles used for deriving impedance.

Referring to FIGS. 1–3, an input transmission line 1 is connected in parallel, at junction 4, to mutually inverted output transmission lines 2,3. Each transmission line has a center conductor 17,24 and exterior shield 18,25 (e.g., a coaxial cable). Transmission lines 1,2 are coupled by their exterior shields 18 and center conductors 17 at junction 4. The center conductors 17 of transmission lines 1, 2 are connected to the exterior shield 25 of transmission line 3, while the center conductor 24 of transmission line 3 is connected to the coupling of exterior shields 18 of transmission lines 1,2 (FIG. 2). These connections cause transmission line 3 to be equal and inverted with respect to transmission line 2. Transmission lines 1–3 pass through ferrite cores 26 which add inductance to prevent current from flowing in exterior shields 18,25. Ferrite cores 26 maintain balance between transmission lines 2,3 by isolating the current on their exterior shields 18,25. The added inductance increases and maintains a high impedance to prevent current flow on exterior shields 18,25.

Exterior shields 18,25 of transmission lines 2,3 may be grounded by connection to the back of a reflector dish 20 at respective junctions 5. Junctions 5 are typically positioned near the center of dish 20 and balun 27, while extending, via bonding or multiple attachment points, to a position near the edge of dish 20 immediately behind ferrite cores 26. Eliminating junction 5, or changing the connection points can be used to tune the low-frequency beam pattern of the antenna. Alternatively, junction 5 can be used to connect shields 18,25 through a network 30 rather than connecting the shields 18,25 to dish 20. Immediately ahead of junctions 5, RC networks 6 may be inserted in the shields 18,25 to impedance-match the input impedance and avoid a DC short. This insertion is typically accomplished by etching, or scoring a small (e.g. 1/32 inch) slit in the shield and bridging the slit with chip capacitors and a chip resistor. The resistive component of RC networks 6 may be set to four thirds of the characteristic impedance of transmission line 1 so that an unbalanced source sees a matched load at DC. The capacitor C of RC networks 6 is one or more high-Q low ESR (equivalent series resistance) microwave capacitors to effectively present a short circuit at microwave frequencies. The value of C is chosen to match the inductance of transmission lines 2,3 so that an unbalanced source sees a matched load at all frequencies. If matching to DC is not necessary, a short circuit (no slit) may be implemented instead of RC networks 6.

Following junctions 5, RC networks 29 may be inserted in order to place a load across shields 18 and 25. This insertion is typically accomplished as described above and other types of networks may be used to place a load across the shields. RC network 29 is adjusted in accordance with network 13 (described below), ferrite cores 26, and whether or not junction 5 is joined to dish 20, so as to control the beam pattern and frequency response at low frequencies.

Following junctions 5 and RC networks 29, transmission lines 2,3 each pass through ferrite cores 26 which add inductance to transmission lines 2,3 to isolate the ends of the feed arms from the input cabling at high frequencies. Transmission lines 2,3 can be embedded within respective feed arms 10,11 and traverse the lengths of the feed arms to apex 12. Alternatively, transmission lines 2,3 can be attached to an outside surface of feed arms 10,11. In both situations, the running of transmission lines 2,3 from balun 27 to apex 12 via the feed arms 10,11 minimizes obstruction of the antenna aperture. In the case where transmission lines 2,3 are embedded in feed arms 10,11, shields 18,25 of transmission lines 2,3 are bonded to feed arms 10, 11 at junctions 28. However, where transmission lines 2,3 are attached to the outside of feed arms 10,11, the position of junctions 28 are not critical and therefore may be omitted. Aperture blockage is minimized because transmission line 1 and balun 27 are mounted behind the antenna while transmission lines 2,3, are collocated or embedded in feed arms 10,11, thereby becoming part of the basic antenna structure.

Center conductors 17,24 of transmission lines 2,3 extend across apex 12 just beyond junctions 8 to connect together either directly, or through a network 14 (FIG. 3 typically a parallel RC circuit). Due to the equal but opposite signals residing on transmission lines 2,3, the connection of center conductors 17,24 forces the two center conductors to form a virtual ground at apex 12 forcing the signal onto shields 18,25 to drive feed arms 10,11 via junctions 8 as described below. Network 14 may be inserted to improve the low frequency return loss characteristics of the antenna, or adjust the frequency response. For applications where return loss must be minimized at DC and low frequencies, the resistive component of network 14 is typically chosen such that, when it is taken in parallel with the resistive components of networks 6, 29, and 13 (described below), it provides the characteristic impedance Z0 at DC on input transmission line 1. For applications where return loss is less important, network 14 is typically a short circuit.

At high frequencies, feed arms 10,11, being driven at junctions 8 as described below, radiate a TEM mode electromagnetic wave with the E (electric) field oriented to start on one feed arm, terminate on the other feed arm, and propagate in the direction of dish 20. This wave reflects off dish 20 and radiates in the preferred direction. At low frequencies, feed arms 10,11, being driven at junctions 8 as described below, form a loop with the parallel combination of: dish 20, networks 13 (described below), and the inductance of cores 26 in series with networks 29 and junctions 5 together with network 30. This loop comprises a loop antenna that also radiates in the preferred direction.

Network 13 can be inserted between feed arms 10,11 and dish 20 to terminate high frequency residual waves and achieve a desired return loss. Network 13 is typically a series RC circuit, however it may include inductors and capacitors to compensate for stray capacitance and inductance. The components of network 13 are determined together with the series connection of: the inductance of cores 26, the networks 29, and the connection of junctions 5 to dish 20, or through network 30. Typically, the components for networks 13, networks 29, network 30, and the length and core material for cores 26 are selected so that the low frequencies flow through the loop containing cores 26, while the high frequencies flow through the parallel loop containing networks 13 such that the antenna yields a low return loss, high energy transfer, and smooth frequency response. The return loss is related to the ratio of the focal length to diameter of dish 20 and networks 13, 29, and 30. Networks 13, 29, and 30 are therefore designed to best match the particular configuration. In the preferred embodiment, the return loss is desired to be better than 20 decibels from DC to 3 GHz.

FIGS. 4*a*, 4*b*, 4*c*, and 5 illustrate several structural aspects of feed arm 11. Feed arm 10 is substantially identical to feed arm 11, and the following description of feed arm 11 is equally applicable to both arms. Specifically, feed arm 11 contains transmission line 2 with external shield 18 (FIG. 1) and center conductor 17 positioned between two substantially triangular shaped styrofoam wedges 15, 16. Wedges 15, 16 and embedded transmission line 2 are wrapped by aluminum shell 19. Aluminum shell 19 is connected to exterior shield 18 of transmission line 2 at junctions 8,28. Alternatively, wedges 15,16 could serve as a coaxial transmission line with a center conductor made of aluminum foil bonded to the styrofoam, with aluminum shell 19 forming the shield. This construction effectively converts feed arm 11 into a large transmission line. A second alternative, is to attach transmission line 2 to a surface of feed arm 11 and connect shield 18 to feed arm 11 at junction 8.

Figure 4A:
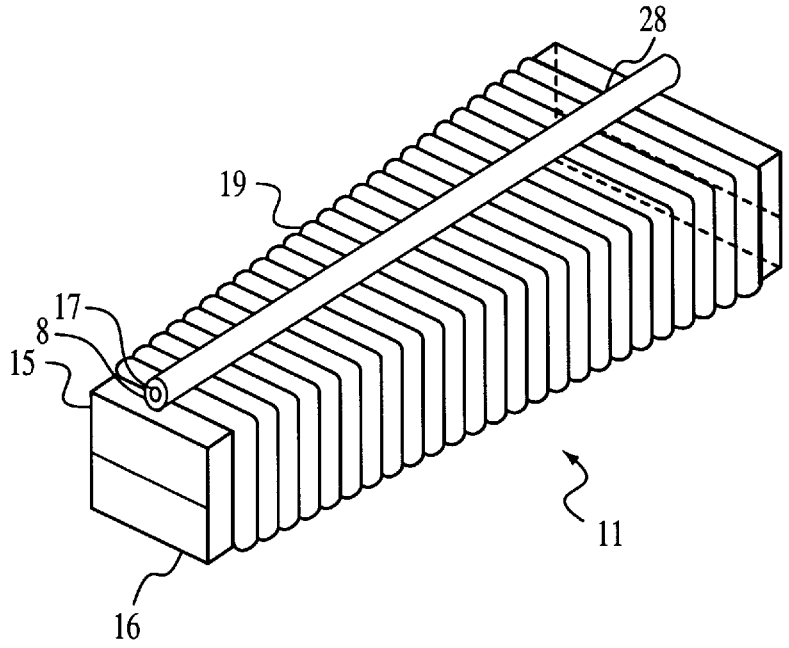
FIGS. 4*a*, 4*b*, and 4*c*, are views in perspective of three embodiments of a transmission line embedded together with the feed arm of the dish antenna of FIG. 1.

FIG. 4*a*, shows the outside of the feed arm 11, bonded to the shield 17 of the coaxial cable 2 running down the outside of the feed arm 11.

Figure 4B:
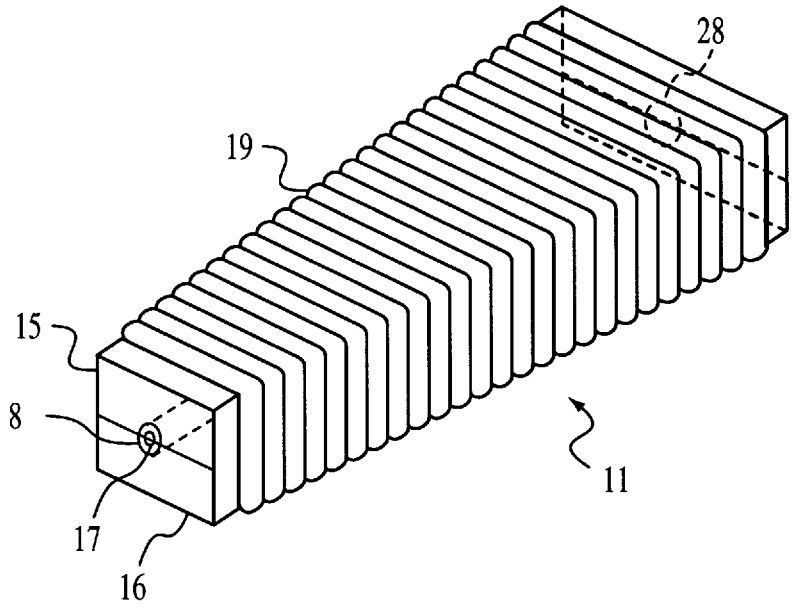

FIG. 4*b*, illustrates an embodiment where a coaxial cable 2, runs down the center of the feed arm 11, with the coaxial shield 17 connected to feed arm 11 aluminum shell 19 at junctions 8, and 28.

Figure 4C:
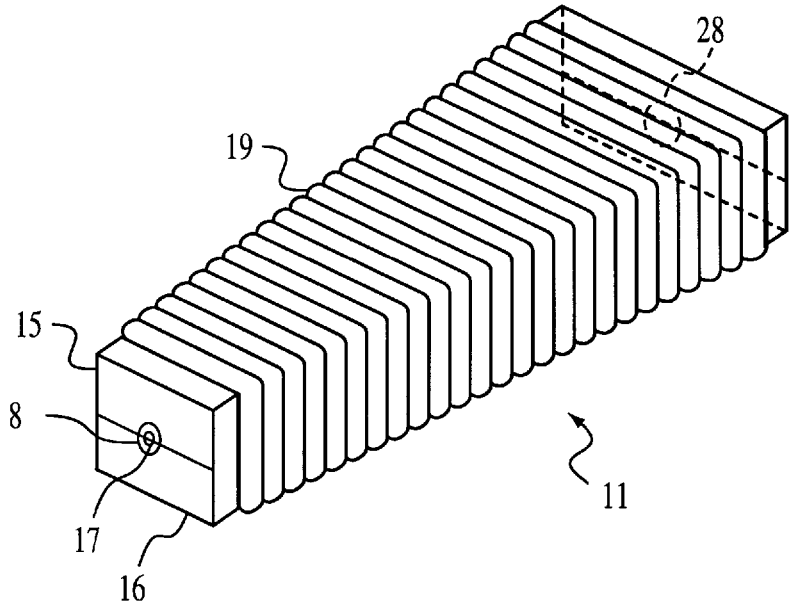

FIG. 4*c* shows the feed arm 11 acting as a transmission line on the inside, where the outside of the feed arm 11 forms the transmission line shield, and where a conductive strip running down the center of the feed arm 11, forms the center conductor. The center conductor in this embodiment is a triangular shaped conductor such that the feed arm exterior is the shield and the entire structure is the coaxial transmission line.7

The input impedance of the feed arms is determined by the angle $\alpha$ of each wedge 15,16 and the angle $\beta$ between feed arms 10 and 11. Specifically, $\alpha=\beta_2-\beta_1$ and $\beta=2\beta_0$ where $\beta$ is measured between centerlines $C_A$ of feed arms 10,11. Angles $\beta_0$,$\beta_1$ and $\beta_2$ and heights $h_1$ and $h_2$ are measured between the centerline of the dish $C_D$ and radially spaced points on feed arm 11 (although feed arm 10 can be used as a mirror image). The following equations are used for the impedance-to-angle relationship:

$$\beta_0=\arctan 1/[2F_d-\tfrac{1}{8}F_d];\ F_d=F/D$$

where F equals the focal length of the dish and D equals the diameter of the dish.

Further, $$\tan(\beta_1/2)=m^{+\frac{1}{4}}\tan(\beta_0/2);\tan(\beta_2/2)=m^{-\frac{1}{4}}\tan(\beta_0/2);$$

and $h_1=F\ \tan(\beta_1)$;$h_{2=F\ tan(\beta 2)}$; where $h_1$ and $h_2$ equal the lower and upper height of each arm respectively, and m is determined from the equation:

$$Z_{feed}/377=K(m)/K(m-1);\ \text{where } K\text{=a complete elliptical integral.}$$

The value of $Z_{feed}$ equals the feed impedance chosen for the antenna and controls the value of m, so that for example, a $Z_{feed}$ of 200 ohms will yield an m of 0.042 and a $Z_{feed}$ of 400 ohms yields an m of 0.56529. The value of m is then used in the above equations to determine the angles for the feed arm.

Table I, shown below, illustrates exemplary calculations for a dish diameter of twenty-four inches.

TABLE I

| Focal Length F(in) | Dish Diameter D(in) | Feed IMPEDANCE $Z_{feed}$ (ohms) | Electrical Center $\beta_0$(Deg) | Small Angle $\beta_1$(Deg) | Large Angle $\beta_2$(Deg) | Lower Height $h_1$(in) | Upper Height $h_2$(in) | Front to Back Ratio $\eta = \cot(\beta_1/2) \times \cot(\beta_2/2)$ |
|---|---|---|---|---|---|---|---|---|
| 24 | 24 | 200 | 28.1 | 12.9 | 57.8 | 5.5 | 38.1 | 16.02 |
| 24 | 24 | 400 | 28.1 | 24.5 | 32.2 | 10.9 | 15.1 | 15.96 |
| 48 | 24 | 200 | 14.3 | 6.5 | 30.9 | 5.5 | 28.7 | 63.72 |
| 48 | 24 | 400 | 14.3 | 12.4 | 16.4 | 10.5 | 14.1 | 63.88 |

Referring to FIG. 1, in operation of the preferred embodiment, an input pulse, typically 30 to 60 kilovolts, is supplied to input transmission line 1. The input pulse is transmitted along line 1 to junction 4 where two equal but opposite pulses are conveyed to transmission lines 2,3 due to transmission line 3 being inverted. In the preferred embodiment, transmission lines 1–3 are implemented by coaxial cable, where transmission line 1 has a characteristic impedance of 50 ohms while transmission lines 2,3 have characteristic impedances twice that of transmission line 1, or 100 ohms. The actual impedances may be altered but transmission lines 2,3 must each maintain twice the characteristic impedance of transmission line 1. The pulses are carried by transmission lines 2,3 through respective feed arms 10,11 to apex 12 where center conductors 17,24 are connected. The connection of center conductors 17,24 at apex 12 forces the connection point to ground as center conductors 17 and 24 have equal but opposite signals thereby forcing shields 18,25 to maintain equal and opposite signals. Feed arms 10,11, being bonded to exterior shields 18,25 at junctions 8, are driven with equal and opposite signals on their exterior shields formed by aluminum shell 19 (FIG. 4). Magnetic and electric fields are created between feed arms 10,11 whereby electromagnetic energy traverses down feed arms 10, 11 into reflector dish 20 where high frequencies are reflected and radiated outward in the preferred direction while low frequencies flow in a loop and also radiate outward in the preferred direction.

At high frequencies, a sinusoidal signal has a short period and an electric field from such a signal does not cover the extent of the antenna. The electro-magnetic waves therefore behave, during reception and transmission, as in optics where reflector dish 20 receives and reflects waves in a parallel formation.

At low frequencies, a sinusoidal signal has a large period, and an electric field from such a signal does cover the extent of the antenna from apex 12 to dish 20, thereby causing the structure to behave as a loop antenna. At low frequencies the voltage induced at the apex 12 terminals (junctions 8 of feed arms 10,11) by the electric field, and the current induced in the loop by the magnetic field, are in phase and therefore add constructively at apex 12 for a field in the preferred direction. For a field propagating opposite to the preferred direction, the current induced in the loop by the magnetic field produces a signal of opposite polarity at the apex 12 terminals (junctions 8 of feed arms 10,11) and therefore combine destructively. However, the polarity of both the electric field component and magnetic field component are in phase and add constructively at network 30 for a field propagating opposite to the preferred direction. Changing the F/D (focal length of dish to diameter of dish) ratio affects the area of the loop relative to the height of the antenna. Also changing the distance between dish 20, and junction 5 with network 30 changes the area of the loop. For applications where a null is desired opposite to the preferred direction, the loop area can be adjusted by either or both above mechanisms to obtain a null. The null is achieved when the sensitivity of the loop to the magnetic field exactly matches the sensitivity of the feed arms to the electric field. When these two sensitivities are matched, then a null is formed because the out-of-phase signals are equal in magnitude so as to destructively add to zero.

Figure 6:
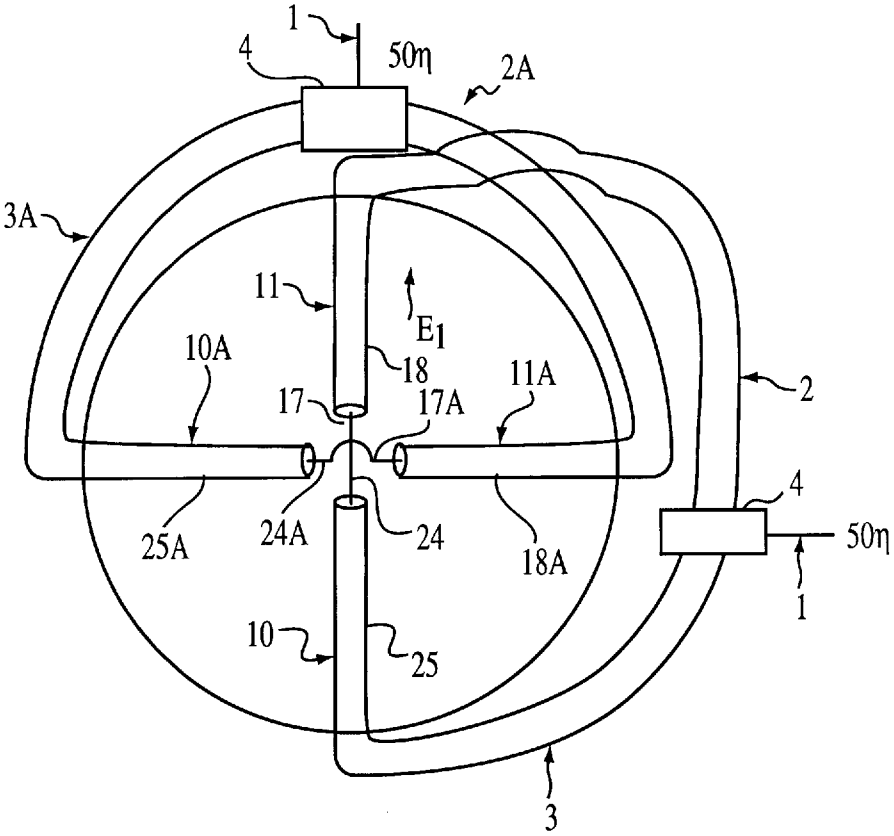
FIG. 6 is a diagrammatic illustration of the dish antenna implemented with four feed arms in accordance with the principles of the present invention to attain dual polarization.

The present invention may be implemented using four feed arms to provide dual polarization. Referring to FIG. 6, the antenna is comprised of a dish, two baluns and two sets or pairs of feed arms, a first set of feed arms 10, 11, and a second set of feed arms 10*a*,11*a* where each of the feed arms 10,ll,10*a*,11*a* have embedded, overlaid or attached transmission lines and input substantially similar to those described above in relation to FIGS. 1–4. The four feed arm embodiment has the second set of feed arms 10*a*,11*a* positioned at orthogonal edges of the dish relative to the first set of feed arms 10,11. Each pair of feed arms 10,11 and 10*a*,11*a* is fed with separate input transmission lines 1. Feed arms 10,11 couple to E-fields oriented to $E_1$ while feed arms 10*a*, 11*a* couple to E-fields oriented to $E_2$. Each of the electric fields are produced in a substantially identical manner to that described above. The resultant waves are dual polarized enabling a single antenna to operate in a manner equivalent to two co-located antennas with reduced space requirements and with no parallax toward a target of source.

Figure 7:
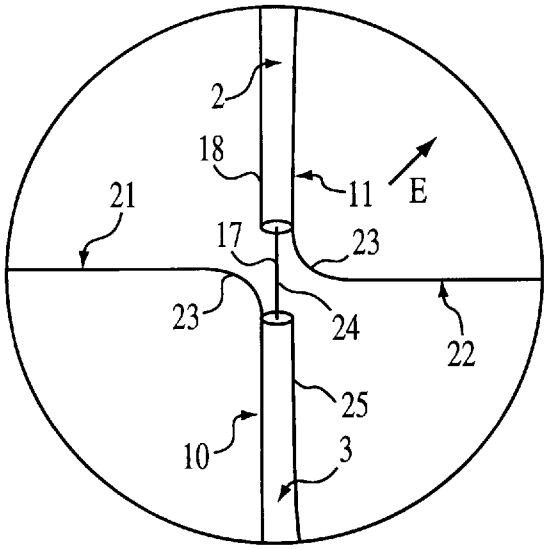
FIG. 7 is a diagrammatic illustration of the dish antenna implemented with four feed arms in accordance with the principles of the present invention to attain reduced feed impedance.

FIG. 7 illustrates another four feed arm embodiment wherein only two feed arms 10,11 have the structure of FIG. 4 as described above. The remaining feed arms 21,22 are positioned orthogonally to feed arms 10,11 at orthogonal edges of the dish. In the preferred embodiment, feed arms 21,22 are constructed as described above in relation to FIG. 4 except that they do not contain transmission lines embedded between the styrofoam wedges. The signal on feed arms 10,11 are derived in the manner described above. Feed arms 21,22 receive signals on their exterior from leads 23 being connected to the exterior of feed arms 10,11. The resulting structure is equivalent to having a vertical and horizontal dipole connected in parallel where the electric field of the vertical dipole points from feed arm 10 towards feed arm 11, and the electric field of the horizontal dipole points from feed arm 21 towards feed arm 22. The resultant electric field of the structure is the vector sum of the vertical and horizontal electric fields, or an electric field E at a forty-five degree angle as shown. The antenna may be rotated to attain the desired polarization. This embodiment enables the impedance of the individual pairs of feed arms to double, thereby reducing (FIG. 5) the height of the feed arms, since both pairs of feed arms 10,11 and 21,22 are connected in parallel. For example, to implement a fifty to two hundred ohm feed and balun according to the present invention, feed arms 10,11 may be made to be four hundred ohms and feed arms 21,22 may also be made to be four hundred ohms such that when connected in parallel they yield the two hundred ohms required by the balun.

Figure 8:
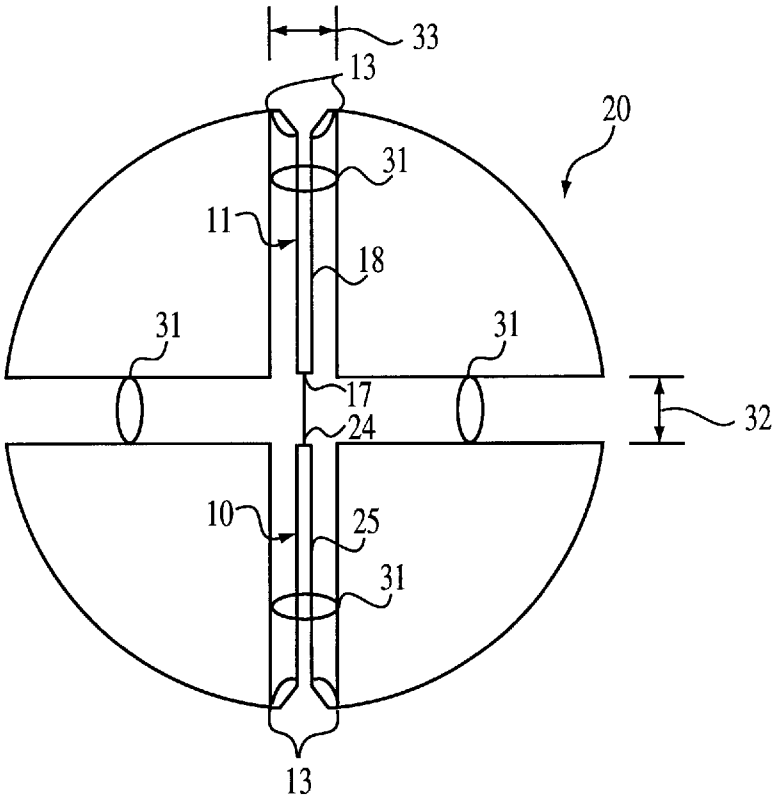
FIG. 8 is a diagrammatic illustration of the dish antenna implemented with the dish partitioned into quadrants.
Figure 9:
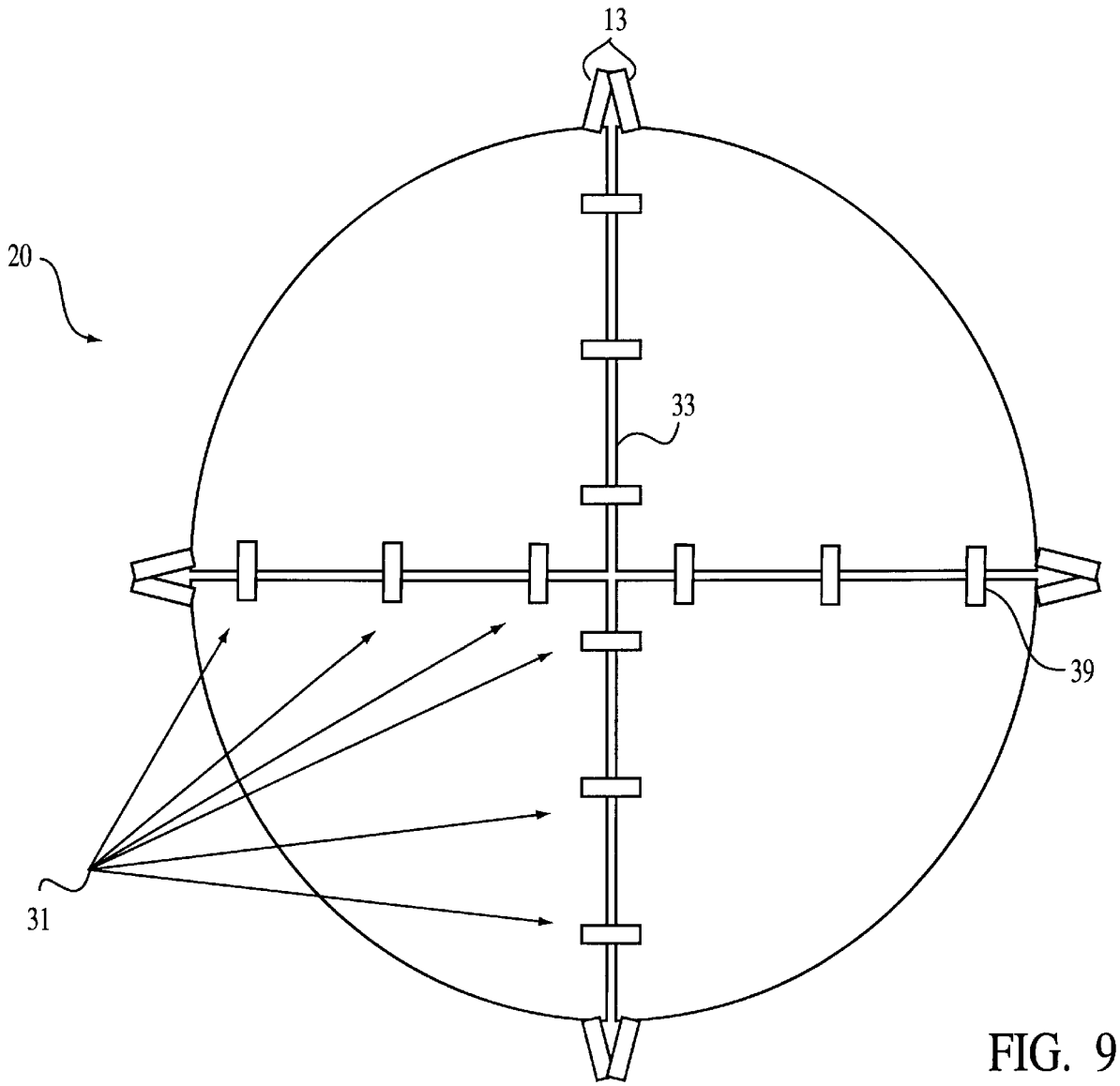
FIG. 9 is a back-view of the dish of FIG. 8.

Referring to FIG. 8, dish 20 may be partitioned into quadrants where each quadrant is separated by gaps 32,33. Gaps 32,33 can have the same or different lengths. The dish may be partitioned into halves where each halve would be separated by gap 32 or 33. Feed arms 10, 11 are positioned parallel to gap 33 between quadrants where center conductors 17,24 are connected to propagate an electromagnetic wave as described above. Further, feed arms 10,11 are connected to quadrants adjacent gap 33 either directly or through networks 13 (as described above). Networks 31 are inserted in gaps 32,33 between all quadrants to provide a load within dish 20 at low frequencies in order to enhance flexibility in the low frequency loop. Networks 31 are typically implemented using a parallel RC network, but other networks may be used. Another pair of feed arms can be inserted within gap 32 in a similar fashion to obtain the four feed arm embodiments described above in FIGS. 6 and 7.

It will be appreciated that the embodiments described above and illustrated in the drawings represent only a few of the many ways of implementing a feed and balun apparatus for an ultra-wide bandwidth dish antenna.

The transmission lines may be implemented by stripline, square coaxial cable, microstrip or any other transmission line means capable of carrying a signal.

The reflecting dish may be implemented by a flat, rectangular or round plate.

The resistive, capacitive and inductive networks may be implemented by chips or any component means having the desired resistive, capacitive and inductive properties.

The reflective dish may be implemented by any means capable of wave reflection in an antenna system.

The feed arms may be implemented by use of other metallic shells capable of conducting a signal along the feed arms.

The substantially triangular wedges of the feed arms may be implemented by any other foams or filler means sturdy enough to maintain arm structure. Further, the feed arms may be cylindrical cone shaped instead of wedge shaped and be made with the same impedances. Furthermore, input transmission line 1 and balun 27 can be replaced by a balanced twin lead input transmission line connected to the center conductors of transmission lines 2,3 in which case the shields of transmission lines 2,3 are also connected.

From the foregoing description it will be appreciated that the invention makes available a novel method and apparatus for an ultra-wide bandwidth dish antenna wherein opposing transmission lines are embedded within feed arms of the antenna and whose center conductors are connected at an apex or convergence point of the feed arms. As used herein, "ultra-wide bandwidth" refers to frequencies from DC to gigahertz (GHz). In addition, the invention makes available a way to mount the apparatus without blocking the aperture of the antenna.

Having described preferred embodiments of a new and improved method and apparatus for an ultra-wide bandwidth dish antenna, it is believed that other modifications, variations and changes will be suggested to those skilled in the art and in view of the teachings set forth herein. It is therefore to be understood that all such variations, modifications and changes are believed to fall within the scope of the present invention as defined by the appended claims.

What is claimed is:

1. An ultra-wide bandwidth antenna comprising:

a reflective dish for reflecting electromagnetic wave energy, said dish having a peripheral edge;

a first feed arm, coupled to said dish at a first location along said peripheral edge, for electrically conducting a first signal to propagate a first wave energy;

a second feed arm, coupled to said dish at a second location along said peripheral edge opposite said first location, for electrically conducting a second signal, inverted relative to said first signal, to propagate said first wave energy;

a first transmission line for conveying said first signal, said first transmission line being at least partially embedded in said first feed arm and including a center conductor and an exterior shield bonded to said first feed arm;

a second transmission line for conveying said second signal, said second transmission line being at least partially embedded in said second feed arm and including a center conductor and an exterior shield bonded to said second feed arm; and an input transmission line for conveying an input signal, said input transmission line being coupled to said first and second transmission lines;

wherein said first and second feed arms converge at a point to form an apex where said center conductors of said embedded first and second transmission lines are connected to propagate said first wave energy along said first and second feed arms into said reflective dish.

2. The antenna of claim 1 wherein each of said first and second transmission lines have a characteristic impedance equal to twice that of said input transmission line.

3. The antenna of claim 1 wherein said first feed arm includes a pair of substantially triangular pieces of foam wrapped by an aluminum shell, said first transmission line is positioned between said foam pieces, and said aluminum shell contacts said exterior shield of said first transmission line.

4. The antenna of claim 3 wherein said second arm includes a further pair of substantially triangular pieces of foam wrapped by a further aluminum shell, said second transmission line is positioned between said foam pieces, and said further aluminum shell contacts said exterior shield of said second transmission line.

5. The antenna of claim 1 and further comprising a plurality of ferrite cores, wherein said first and second transmission lines each pass through at least one of said ferrite cores.

6. The antenna of claim 1 and further comprising an RC network wherein said first and second center conductors connect at said apex through said RC network to improve return loss at low frequencies.

7. The antenna of claim 1 and further comprising a first RC network inserted into said exterior shield of said first transmission line, and a second RC network inserted into said exterior shield of said second transmission line to impedance match an input impedance so as to avoid a DC short.

8. The antenna of claim 1 and further comprising a first RC network between said reflective dish and said first feed arm and a second RC network between said reflective dish and said second feed arm to terminate high frequency residual waves and achieve a desired return loss of said antenna.

9. The antenna of claim 1 and further comprising:

a third feed arm, coupled to said dish at a third location along said peripheral edge between said first and second locations for electrically conducting a third signal to propagate a second wave energy orthogonal to said first wave energy;

a fourth feed arm, coupled to said dish at a fourth location along said peripheral edge opposite said third location, for electrically conducting a fourth signal, inverted relative to said third signal, to propagate said second wave energy;

a third transmission line for conveying said third signal, said third transmission line being at least partially embedded in said third feed arm and including a center conductor and an exterior shield bonded to said third feed arm;

a fourth transmission line for conveying said fourth signal, said fourth transmission line being at least partially embedded in said fourth feed arm and including a center conductor and an exterior shield bonded to said fourth feed arm; and a second input transmission line for conveying a second input signal, said second input transmission line being connected to said third and fourth transmission lines;

wherein said third and fourth feed arms converge at a point to form an apex where said center conductors of said embedded third and fourth transmission lines are connected to propagate, with said first and second arms, said electromagnetic wave energy, having dual-polarization, into said reflective dish.

10. The antenna of claim 1 and further comprising:

a third arm for propagating a second wave energy orthogonal to said first wave energy, said third feed arm coupled to said dish at a third location along said peripheral edge between said first and second locations, said third feed arm receiving said second signal through a lead coupled to said second feed arm;

a fourth arm for propagating said second wave energy, said fourth arm coupled to said dish at a fourth location along said peripheral edge opposite said third location, said fourth arm receiving said first signal through a lead coupled to said first feed arm;

wherein said third and fourth feed arms propagate said second wave energy down said third and fourth feed arms into said reflective dish.

11. The antenna of claim 1 wherein said reflective dish is formed of a plurality of quadrants separated by a gap.

12. The antenna of claim 1 wherein said reflective dish is formed of two half dishes separated by a gap.

13. The antenna of claim 11 wherein adjacent quadrants are connected through networks.

14. The antenna of claim 11 further comprising a first pair of RC networks between said first feed arm and each quadrant and a second pair of RC networks between said second feed arm and each quadrant.

15. In an ultra-wide bandwidth dish antenna, a method of applying balanced signals to said dish antenna comprising the steps of:

(a) applying a signal to an input transmission line;

(b) transferring said signal to each of two receptive transmission lines where one of said receptive transmission lines is electrically inverted relative to the other;

(c) running said receptive transmission lines along separate converging feed arms of said dish antenna;

(d) transmitting said signal through said receptive transmission lines;

(e) connecting center conductors of said receptive transmission lines together at a point where said separate feed arms converge;

(f) connecting shields of said receptive transmission lines to each of said separate feed arms, respectively, to conduct said signal to an exterior part of each of said separate feed arms to create an electric and magnetic field;

(g) propagating wave energy of said electric and magnetic fields into a reflective dish of said dish antenna; and (h) reflecting said wave energy outward from said reflective dish.

16. The method of claim 15 wherein step (e) includes connecting center conductors through an RC network at said point where said feed arms converge to improve return loss at low frequency.

17. The method of claim 15 wherein said step (f) further includes utilizing an RC network between each said separate feed arm and said reflective dish to terminate high frequency residual waves to achieve a desired return loss of said dish antenna.

18. The method of claim 17 whereun said reflective dish is formed of a plurality of quadrants separated by a gap.

19. The method of claim 18 wherein adjacent quadrants are connected by networks.

20. In an ultra-wide bandwidth dish antenna having four converging feed arms, a method of applying balanced signals to said dish antenna comprising the steps of:

(a) applying a first signal to a first input transmission line and applying a second signal to a second input transmission line;

(b) transferring said first signal from said first input transmission line to each transmission line of a first pair of receptive transmission lines, where one of said receptive transmission lines in said first pair is inverted relative to the other;

(c) transferring said second signal from said second input transmission line to each transmission line of a second pair of receptive transmission lines where one of said receptive transmission lines in said second pair is inverted relative to the other;

(d) running each of said receptive transmission lines of said first and second pair of receptive transmission lines along separate feed arms of said dish antenna;

(e) transmitting said first signal of said first input transmission line through said first pair of receptive transmission lines and transmitting said second signal of said second input transmission line through said second pair of receptive transmission lines;

(f) connecting respective center conductors of said first pair of receptive transmission lines together, and connecting respective center conductors of said second pair of receptive transmission lines together, at a point where said separate feed arms converge;

(g) connecting respective shields of said first and second pair of receptive transmission lines to each of said separate feed arms to conduct said first and second signals on an exterior part of each of said separate feed arms to create an electric and magnetic field;

(h) propagating wave energy of said electric and magnetic fields into a reflective dish of said dish antenna; and (i) reflecting said wave energy, having dual-polarization, outward from said reflective dish.

21. The antenna of claim 20 wherein said reflective dish is formed of a plurality of quadrants separated by a gap.

22. The antenna of claim 21 wherein adjacent quadrants are connected through networks.

23. The antenna of claim 21 further comprising RC networks between said quadrants and said feed arms.

24. In an ultra-wide bandwidth dish antenna comprising four converging feed arms, a method of applying balanced signals to said dish antenna comprising the steps of:

(a) applying a signal to an input transmission line;

(b) transferring said signal to each of two receptive transmission lines where one of said receptive transmission lines is inverted relative to the other;

(c) running said receptive transmission lines along two separate feed arms of said dish antenna;

(d) transmitting said signal through said receptive transmission lines;

(e) connecting respective center conductors of said receptive transmission lines together at a point where said feed arms of said dish antenna converge, and connecting said feed arms not containing said receptive transmission lines to said feed arms that do contain said receptive transmission lines;

(f) connecting shields of said receptive transmission lines to each of said two separate feed arms to conduct said signal on an exterior part of each of said feed arms of said dish antenna to create an electric and magnetic field;

(g) propagating wave energy of said electric and magnetic fields into a reflective dish of said dish antenna; and (h) reflecting said wave energy outward from said reflective dish.

* * * * *